United States Patent [19]

Ditto et al.

[11] 3,952,922

[45] Apr. 27, 1976

[54] PRECESSING BOTTOM POUR STOPPER HAVING SWINGING MOVEMENT

[75] Inventors: Edwin D. Ditto, Bloomfield Hills; A. Hadi K. Akeel, Sterling Heights, both of Mich.

[73] Assignee: General Motors Corporation, Detroit, Mich.

[22] Filed: June 27, 1975

[21] Appl. No.: 591,141

[52] U.S. Cl. ..... 222/148; 137/331; 222/508

[51] Int. Cl.[2] ..... B22D 41/10

[58] Field of Search ..... 222/505, 508, 544, 148; 137/330, 331, 243, 243.6

[56] References Cited

UNITED STATES PATENTS 3,643,680 2/1972 Hall et al. ..... 137/331

FOREIGN PATENTS OR APPLICATIONS 166,049 1/1905 Germany ..... 222/602

*Primary Examiner*—Robert B. Reeves
*Assistant Examiner*—David A. Scherbel
*Attorney, Agent, or Firm*—Jack I. Pulley

[57] ABSTRACT

In accordance with a preferred embodiment of this invention, a precessing bottom pour stopper is used to accurately and precisely control the flow of molten metal through the tap hole which is located in the bottom of a metallurgical vessel. The precessional movement of the stopper, as it moves into and/or out of sealing engagement with the tap hole, removes any debris which may be lodged between the sealing surfaces and thereby ensures a tight seal over a prolonged period of operation.

3 Claims, 6 Drawing Figures

PRECESSING BOTTOM POUR STOPPER HAVING SWINGING MOVEMENT

FIELD OF THE INVENTION

This invention relates to bottom pour stoppers for use in vessels adapted to hold molten metal or the like.

BACKGROUND OF THE INVENTION

In the casting of metals, bottom pour vessels have long presented leakage problems; particularly so when the metal is molten cast iron which has been treated to form modular iron upon solidification. Such molten has a strong tendency to precipitate solid matter especially in the cooler regions in the area of a bottom pour stopper and tap hole. Any debris lodged between the engaging surfaces of the stopper and tap hole will cause leaks, poor control of the amount of metal discharged and a considerable waste of molten metal. These problems necessitate the frequent cleaning of the tap hole area which is an expensive maintenance operation.

Several techniques have been tried to solve this problem. For example, bottom pour stopper elements have been equipped with heating means to prevent formation of cool spots which promote the undesired precipitation. In addition, rotating stopper elements which simply rotate about their axis to clean the sealing surfaces have also been employed. However, these techniques have not proved entirely successful in eliminating the leakage problems.

This invention is directed toward a more accurate pouring and more maintenance-free bottom pour stopper apparatus for use in a vessel adapted to hold molten metal. The stopper apparatus comprises a rigid cylindrical stopper which controls the flow of molten metal from the vessel through a tap hole located in the bottom. Accordingly, it is an object of this invention to provide a bottom pour stopper apparatus in wich the stopper is inclined to the axis of the tap hole of the vessel. Moreover, as the stopper is moved into its tap hole closing position it is revolved and rotated by the apparatus so as to push or abrade any debris from between the sealing surfaces. More specifically, while the end of the stopper is in the tap hole, the stopper rotates about its own axis and also revolves about an axis through its lower end so that its path describes an inverted cone. These combined motions, often termed precession, provide the desired abrasive action on debris collecting in the tap hole.

The subject stopper apparatus promotes a tight seal over a long period of operation and thereby prevents leakage and provides a constant and controllable quantity of metal with each discharge operation. The precessional motion of the subject stopper apparatus will provide, among other features, a vertical component in the motion of each point on the stopper's sealing surface relative to an adjacent point on the sealing surface of the tap hole. The effect of this vertical compound is to positively remove any debris from between these surfaces. In addition, these combined motions also provide uniform wearing of the sealing surfaces, and thereby prevent the formation of grooves in these surfaces which would act as leakage paths for the molten metal. The net speed and velocity of the stopper, as provided by these combined motions, are preferably selected so that any point on the sealing surface of the stopper element will travel about at least once around the vertical axis of the tap hole while the sealing surfaces are slidably engaged, during each sealing and/or unsealing operation.

The subject invention will be more readily understood in view of a detailed description thereof which will make frequent references to the accompanying drawings wherein.

DETAILED DESCRIPTION OF THE INVENTION

Figure 6:
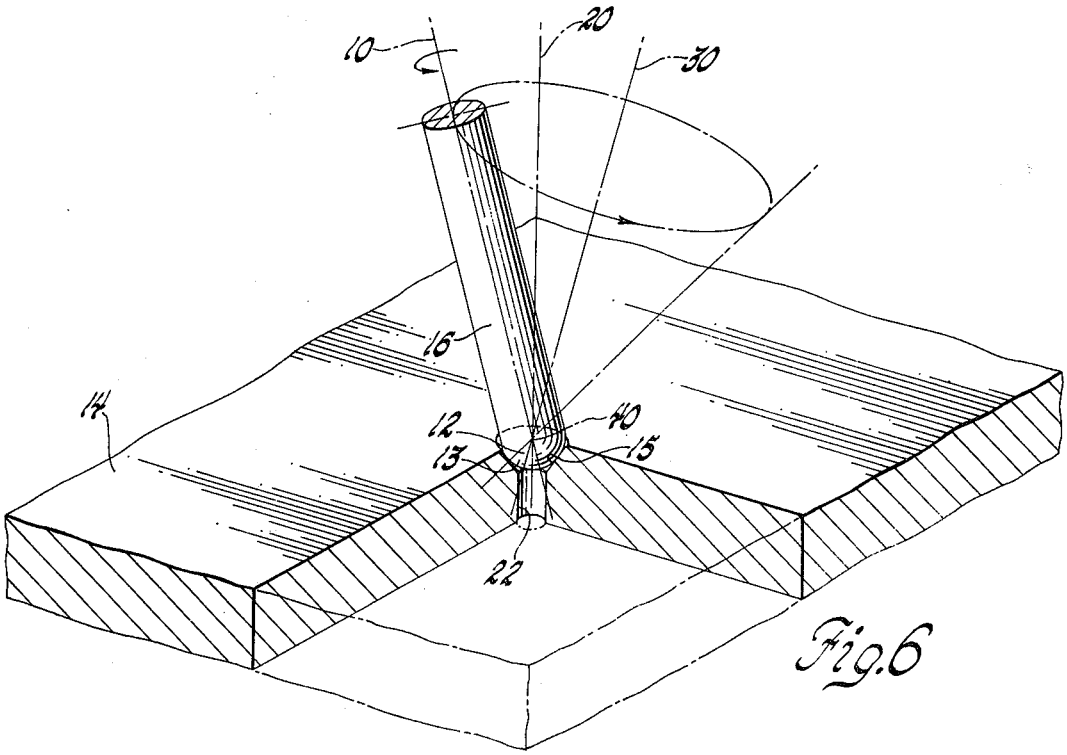
FIG. 6 is a perspective view showing the various motions of the subject stopper.

In accordance with the practice of this invention, a bottom pour stopper apparatus is provided wherein the stopper 16, as shown in FIG. 6, has a hemispherical sealing end portion 12 and rotates about its own axis 10. In addition, the stopper 16 simultaneously revolves about axis 30 so as to define all or a portion of the surface of an inverted cone 31 having its apex at the point where the axis 10 and the axis of revolution 30 intersect. Preferably, axes 10 and 30 and the vertical axis 20 of tap hole 22 intersect at a single point which preferably is the center 40 of hemispherical end portion 12. The precessional motion, described above, occurs during the sealing and/or unsealing movement of the stopper 16 while hemispherical end 12 is engaged with the conical sealing surfaces 15 of tap hole 22. This provides an abrasive cleaning action which positively removes solid debris from the seal area because the motion of a point on the hemispherical end 12 has a vertical component relative to a point on surface 15.

It is not critical to the practice of this invention that the stopper 16 rotate a specific amount or that the axis 10 of the stopper 16 revolve a specific amount during each sealing and/or unsealing operation. Likewise, the rates of rotation and revolution are not critical to the practice of this invention. However, during each sealing and/or unsealing operation and while the sealing surface 13 of the stopper 16 is engaged with the sealing surface 15 of the tap hole 22, a point on the sealing surface 13 of stopper 16 should complete about at least one revolution around axis 20 of tap hole 22.

Figure 1:
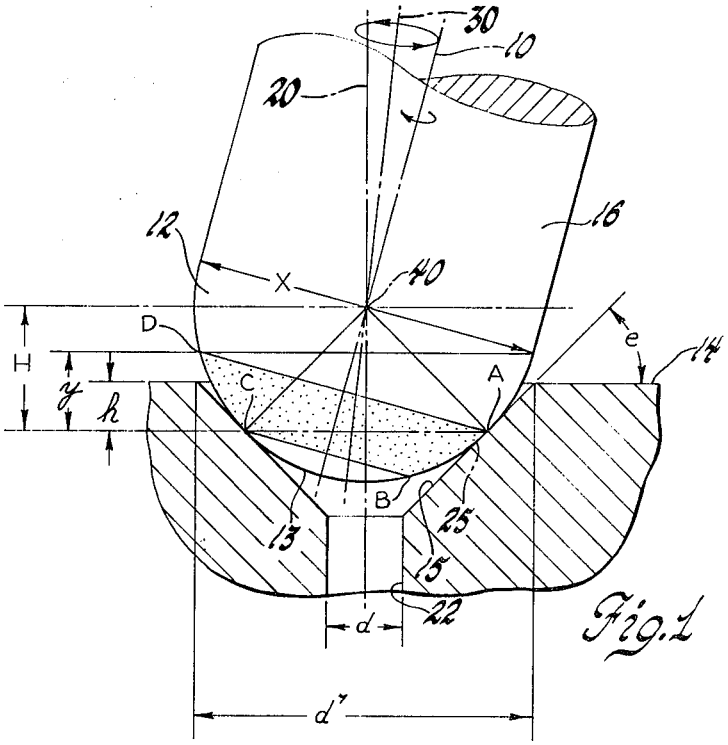
FIG. 1 is a cross sectional view of the spherical end of the stopper in sealing engagement with the tap hole.

The diameter $x$ of the hemispherical end 12 of stopper 16, in FIG. 1, the diameter $d$ of the tap hole 22 and the angle $e$ between the sealing surface 15 of tap hole 22 and the bottom surface 14 of the vessel, are suitably selected so that the horizontal circular line of contact 25 between the hemispherical end 12 and sealing surface 15 the tap hole 22, is located well below the bottom surface 14 of the vessel; however, the exact location of the plane of contact 25 may vary relative to surface 14.

As the stopper 16 precesses, the points on the sealing surface 13 of the hemispherical end portion 12, which at one time or another actually form the seal at the line of contact 25 will generate an annular locus of points on a spherical surface. In FIG. 1, this locus is the shaded area defined by the letters ABCD. This locus will describe the total area defined by the motion of points on end portion 12, which points at one time or another form the seal at the circular line of contact 25 with sealing surfaces 15 of tap hole 22. It is preferred that this locus of points ABCD have an upper limit at point D which is above surface 14 to allow the sealing surface 13 to carry solid debris completely from the area of the sealing surfaces. This may also allow the stopper to break off any sludge which may accumulate at the edge formed by the intersection of surface 14 and sealing surface 15.

It is to be noted that if the stopper element were positioned vertically and simply rotated about its own axis that the locus of points in actual contact with the sealing surfaces 15 of tap hole 22 would be simply those points on the line of contact 25. This condition would cause excessive wear at these points and would provide no vertical component in the motion of the points on the hemispherical end portion 12 of stopper 16 relative to points on the sealing surface 15 of tap hole 22. From this it is readily apparent that the subject combination of motions will provide more effective means of removing debris from between the sealing surfaces and provide more uniform wear thereof. On the other hand, if the stopper 16 were simply inclined at an angle to the vertical axis 20 of tap hole 22 and then rotated about its own axis 10, there would be an uneven distribution of the sealing pressure acting parallel to the axis of stopper 16. More specifically, point C would be subjected to the greatest pressure and point A would be subjected to the lowest pressure. This condition would produce uneven wear of sealing surface 15 and would cause premature leakage. From this it is readily evident that the subject apparatus will provide a more effective means of removing debris from the tap hole promote more uniform wear of the sealing surfaces than the simply inclined and rotating stopper.

The following dimensions are included to provide a specific example of a preferred embodiment. In this embodiment, the small diameter *d* of the tap hole 22 is 1 inch and the large diameter *d* of the hole 22 is 4½ inches. The angle *e* between the sealing surfaces 15 and the horizontal plane 14 is 45°, and the radius *x*/2 of the stopper is 2½ inches. In this configuration, the center 40 of the hemispherical stopper end 12 will lie a distance H of 1.77 inches above the circular line of contact 25 which will have a diameter of about 3½ inches. If the precessing stopper element is inclined from the vertical axis 20 at a fixed angle of 10° the locus of points on the hemispherical sealing surface which at one time or another form the line of contact 25 will have an upper limit DA which will extend a distance *y* which is about 0.7 of an inch above the circular line of contact 25 and a distance *y-h* of about 0.2 of an inch above surface 14.

Figure 2:
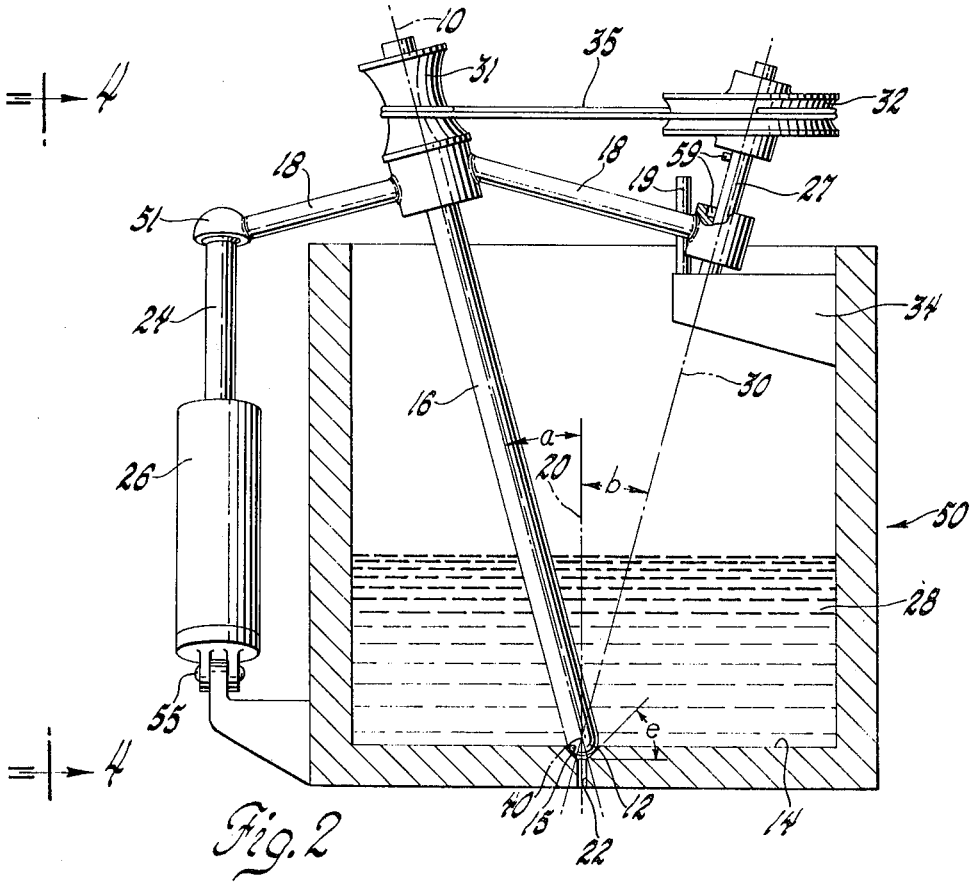
FIG. 2 is an elevational view in cross section of a metallurgical vessel equipped with a preferred embodiment of the subject bottom pour stopper apparatus.
Figure 3:
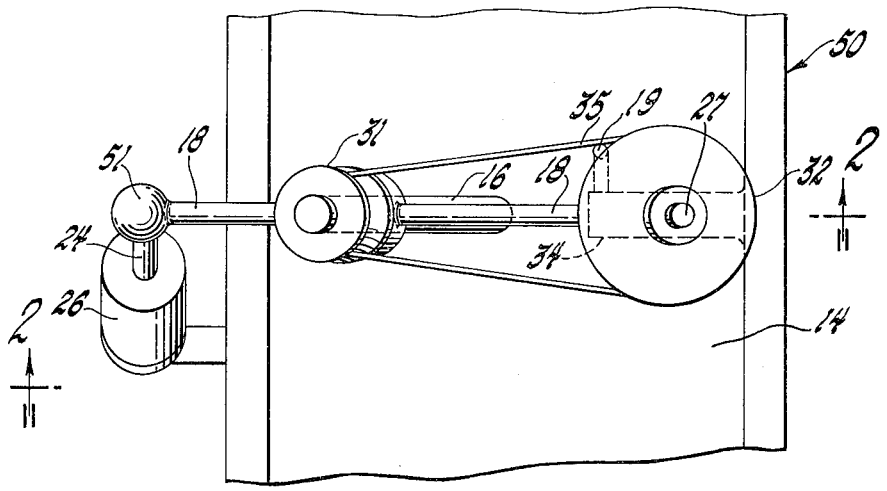
FIG. 3 is a plan view of the apparatus depicted in FIG. 2.
Figure 4:
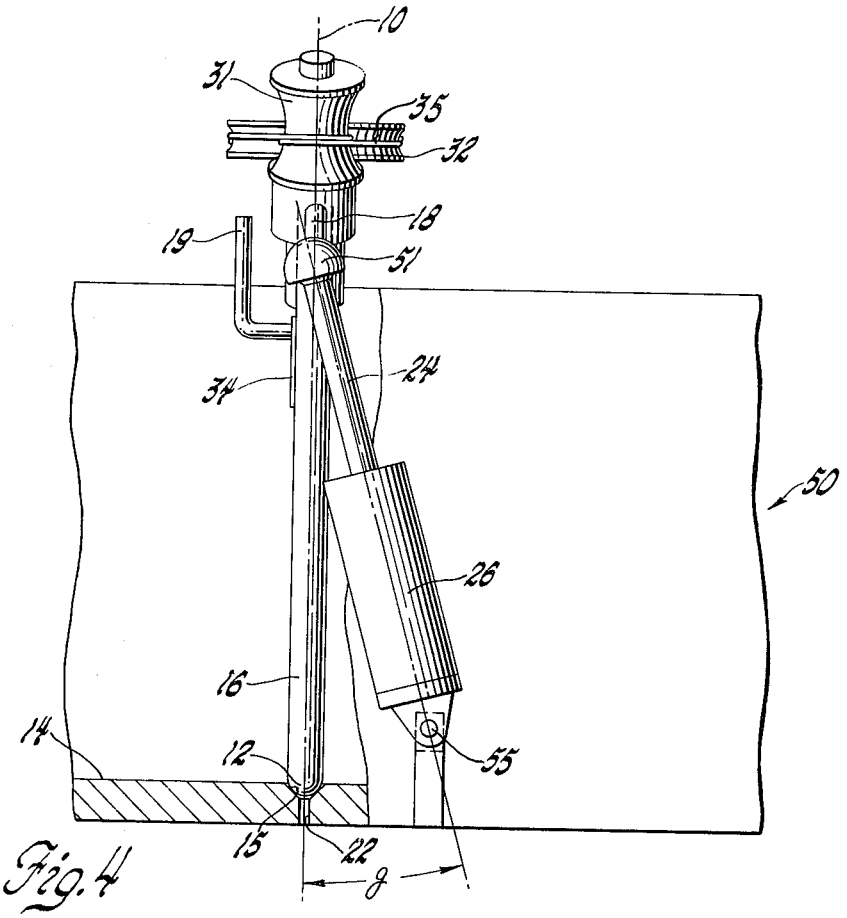
FIG. 4 is a side view of the apparatus shown in FIGS. 2 and 3 taken in the direction of line 4—4 in FIG. 2.

A preferred embodiment of the subject invention is illustrated in FIGS. 2, 3 and 4 wherein FIG. 2 is a cross sectional view of a metallurgical vessel 50 taken on section 2—2 in FIG. 3, which is a plan view of this embodiment. As shown in FIG. 2, the rigid stopper 16 is rotatably supported at an angle *a* to the vertical axis 20 of the tap hole 22 in a movable holder 18 which is pivotally and slidably mounted on support arm 27. In turn, the support arm 27 is securely mounted at angle *b* from the vertical axis 20 to a fixture 34; fixture 34 is securely mounted to vessel 50. Support arm 27 is mounted so that its longitudinal axis, which in this embodiment serves as the axis of conical revolution 30, passes through the center 40, of the hemispherical end portion 12 of stopper 16. Holder 18 revolves about axis 30 of support arm 27 so as to move the stopper 16 along a conical surface; holder 18 also slides on support arm 27 so as to move stopper 16 into and out of sealing engagement with tap hole 22. To accomplish these motions, holder 18 is connected to cylinder rod 24 so as to provide limited universal movement at this joint 51. Piston rod 24 is actuated by hydraulic cylinder 26 which is pivotally mounted at point 55 onto the outside surface of vessel 50 in a manner such that the longitudinal axis of cylinder 26 forms an acute angle *g* of about 15° with the vertical axis 20, see FIG. 4. In this configuration the angle *g* must be such that the horizontal component of the force exerted by cylinder 26 will generate a moment about axis 30 greater than the sum of the pivotal frictional resistance between arm 27 and holder 18 and the pivotal frictional resistance between the sealing surface 13 of stopper 16 and sealing surface 15 of tap hole 22. In addition, angle *g* must be such that the vertical component of the force exerted by cylinder 26 is not sufficient to lift the stopper from sealing engagement with the tap hole 22 until the holder 18 hits stop 19, which is positioned to allow holder 18 to revolve through an angle of from about 30° to about 60°. Therefore, when the stopper is in a sealing position, and the cylinder arm 24 is thrust out, the stopper first revolves about axis 30 and then is lifted from a sealing position to allow the liquid 28 in vessel 50 to flow through tap hole 22.

Conversely, when the stopper is in the open position and the cylinder arm 24 is retracted by cylinder 26, the vertical component of the force exerted by the cylinder 26 and the weight of the stopper apparatus is preferably greater than the sliding friction resistance of holder 18 on arm 27. Thus, the stopper would first drop into tap hole 22 once the cylinder arm 24 began to retract. In addition, it is preferred that the moment about axis 30 generated by the horizontal component of the force exerted by the cylinder 26, is not sufficient to pivot holder 18 about arm 27 until the stopper has dropped into tap hole 22. The rotation of holder 18 about arm 27 in the extracted position, may be positively prevented by the use of a pin and slot configuration as indicated by reference 59 in FIG. 2. However, it is to be emphasized that the subject abrasive action generated by the precessional motion of the stopper need not occur during each and every sealing and unsealing operation. It is within the scope of this invention if the subject abrasive action occurs only during the sealing step or only during the unsealing step. Furthermore, once every second, third or fourth sealing operation may be sufficient to maintain a good seal at the tap hole 22.

As the stopper 16 revolves about axis 30, a pulley arrangement causes the stopper 16 to also rotate on its own axis 10. In this pulley arrangement, a first pulley 31 is securely attached to the upper end of stopper 16 which is rotatably mounted in holder 18. In addition, a nonrotatable second pulley 32 is securely mounted onto support arm 27. A cable 35 is wrapped around first pulley 31 and also wrapped around and secured to second pulley 32. As the stopper 16 revolves around the axis of support arm 20, the stopper 16 will rotate an angle which is inversely proportional to the diameter of the first pulley 31 and proportional to both of the distance between the centers of pulleys 31 and 32 and the total angle travelled by holder 18 around axis 30.

Figure 5:
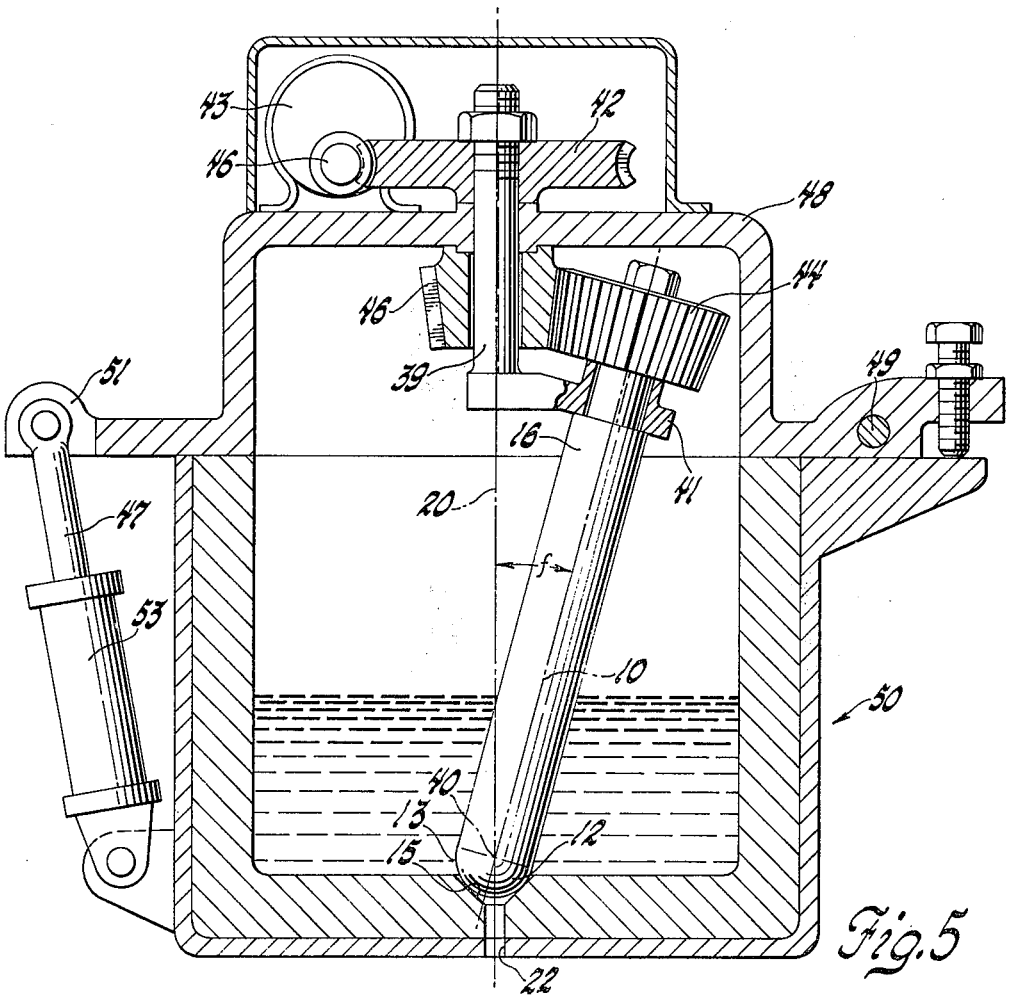
FIG. 5 is a cross sectional view of another embodiment of the subject invention.

FIG. 5 illustrates a bottom pour stopper mechanism which provides a combination of stopper motions in accordance with another preferred embodiment of subject invention. In this mechanism, the stopper 16 has a substantially hemispherical sealing end portion 12 and is rotatably mounted in support arm 41 at acute angle *f* to the vertical axis 20 of tap hole 22. Support arm 41 is securely fastened through shaft 39 to a horizontally mounted worm gear 42. Axis 20 of tap hole 22 intersects stopper axis 10 at the center 40 of hemispherical end portion 12. Motor 43 drives worm 46 which meshes with and causes worm gear 42 and shaft 39 to rotate about its axis, which is coincident with the vertical axis 20 of tap hole 22. Worm gear 42 is rotatably mounted on the upper surface of support cover 48. The rotation of worm gear 42 and shaft 39 causes support arm 41 to rotate about axis 20 and thereby causes inclined stopper 16 to revolve about axis 20 at angle *f* and thereby generate a conical surface about axis 20. Securely fastened to the upper end of stopper 16 is planet gear 44 which intermeshes with a horizontal fixed sun gear 46 which is securely mounted to the undersurface of support cover 48. Fixed gear 46 is positioned such that its vertical axis is coincident with axis 20 of tap hole 22. As stopper 16 revolves about axis 20 of tap hole 22, gears 44 and 46 and support arm 40 act as an epicyclic gear train wherein fixed gear 46 is a fixed sun gear and gear 44 is a revolving planet gear which rotates on its own axis 10. In addition, that portion of support arm 41 which extends out from axis 20 serves as the conventional arm in the epicyclic gear train. Stopper element 16 rotates about its own axis 10 as it revolves in a conical fashion about axis 20, and the rate of revolution of stopper 16 about axis 20 will be a function of the speed of motor 43, and the pitch of worm 46 and the diameter of worm gear 42. The rate of rotation of stopper about its own axis 10, will be a function of the diameters of gears 44 and 46.

Support cover 48 is pivotally attached to vessel 50 at pivot point 49 and is actuated by rod 47 of cylinder 53 which is securely mounted and pivotally connected to support cover 48 at point 51, in a vertical position to vessel 50. As rod 47 is thrust out, support 48 is pivoted about point 49 and stopper 16 is lifted from sealing engagement with the sealing surface 15 of tap hole 22. The molten metal 28 is thereby allowed to flow through the tap hole. After a predetermined amount of metal has been discharged, rod 47 will retract and stopper 16 will be lowered into sealing engagement with the sealing surface 15 of tap hole 22. During each sealing and/or unsealing cycle, and while the sealing surface 25 of stopper 16 is slidably engaged with sealing surface 15 of tap hole 22, the combined rotation and revolution of stopper 16 should move a point on sealing surface 25 at least about once around axis of tap hole 22. The exact rate or degree of either motion is not critical so long as this minimum is met. In this embodiment support arm 41 may have a circular disc shape to protect the subject epicyclic gear train from the hot metal environment.

While our invention has been described in terms of certain specific embodiments, it will be appreciated that other forms thereof could readily be adapted by one skilled in the art. Therefore, the scope of our invention is not to be limited to the specific embodiments disclosed.

What is claimed is:

1. A bottom pour stopper mechanism, suitable for use with a vessel for holding and pouring molten metal and the like, for precisely controlling the intermittent flow of molten metal through a tap hole in the bottom of the vessel over a prolonged period despite the presence of slag particles or other debris in the area of the tap hole, the tap hole having a substantially conical sealing surface at the inner surface of the vessel, the mechanism comprising:

a. a rigid cylindrical stopper disposed in the vessel and movable between a tap hole open position and a tap hole closed position, the stopper having a substantially hemispherical end adapted to fit in sealing engagement with the conical sealing surface of the tap hole in said closed position, the stopper further being disposed such that when it is in the closed position the longitudinal axis of the cylindrical stopper is at an acute angle with and intersecting the axis of the tap hole;

b. stopper support means mounted on the vessel;

c. means for raising and lowering the support means to move the stopper between its said open and closed positions;

d. means for rotating the cylindrical stopper about its longitudinal axis, the stopper rotating means being mounted on the vessel; and e. means for revolving the stopper about its lower end so as to define a portion of a conical surface as the stopper rotates on its own axis, the revolving means being mounted on the vessel, wherein the rotation and revolution of said stopper, as it engages the seat portion of the tap hole, acts to abrasively clean and seal the tap hole by directly pushing debris from between the engaging surfaces.

2. A mechanism, suitable for use with a bottom pour vessel for holding and pouring molten metal and the like, for precisely controlling the intermittent flow of molten metal through a tap hole in the bottom of the vessel over a prolonged period of operation despite the presence of debris in the area of the tap hole, the tap hole having a substantially conical sealing surface at the inner surface of the vessel, the mechanism comprising:

a. a rigid cylindrical stopper disposed in the vessel and movable between a tap hole open position and a tap hole closed position and having a hemispherical end adapted to fit in sealing engagement with the sealing surface of the tap hole in said closed position, the stopper further being disposed when in its closed position with its longitudinal axis at an acute angle with and insecting the vertical axis of the tap hole;

b. stopper support means mounted on the vessel;

c. means for raising and lowering the support means so as to move the stopper between said open and closed positions with the tap hole and thereby controlling the intermittent flow of molten metal therethrough;

d. an epicyclic gear train consisting essentially of a sun gear securely fixed to the support means with the axis of the sun gear substantially on the vertical axis of the tap hole, a planet gear meshed with the sun gear and securely mounted to the upper end of the stopper such that the vertical axis of the planet gear is coincident with the longitudinal axis of the stopper, and a support arm rotatably mounted on the support means so as to rotate about the axis of the sun gear, the stopper being carried by said arm such that the stopper may rotate in said arm as it rotates about the axis of the sun gear; and e. drive means to rotate the support arm about the axis of the sun gear.

3. A stopper mechanism, suitable for use in a bottom pour vessel for holding and pouring molten metal and the like, which mechanism precisely controls the intermittent flow of molten metal through a tap hole in the bottom of the vessel over a prolonged period despite the presence of debris in the area of the tap hole, the tap hole having a substantially conical sealing surface at the inner surface of the vessel, the mechanism comprising:

a. a rigid cylindrical stopper disposed in the vessel and movable between a tap hole open position and a tap hole closed position, the stopper having a substantially hemispherical end adapted to fit in sealing engagement with the sealing surface of the tap hole and the stopper further being disposed when in said closed position with its longitudinal axis at an acute angle with and intersecting the axis of the tap hole;

b. an upstanding first support arm fixed to the vessel such that the longitudinal axis of the support arm is at an acute angle to and intersects the tap hole axis at a point substantially at the center of the hemispherical end of the stopper when it is in said closed position;

c. a stopper carrying second support arm reaching from the first arm generally across the vessel, the second arm being slidably and revolvably attached to said first arm, said stopper being rotatably mounted in said second arm such that as said second arm revolves about said first arm, said stopper revolves about the axis of said first arm so as to define a conical surface and such that as said second arm slides on said first arm said stopper is moved between said open and said closed positions;

means to revolve said second arm about said first arm while said stopper is in said closed position;

means to slide said second arm on said first arm so as to move said stopper between said open and said closed position;

means to rotate said stopper about its longitudinal axis as said stopper revolves around said first support arm.

* * * * *